US006825815B1

(12) United States Patent
Harmon

(10) Patent No.: US 6,825,815 B1
(45) Date of Patent: Nov. 30, 2004

(54) STEERABLE UPLINK ANTENNA FOR MOVEABLE REDUNDANT BEAMS

(75) Inventor: Garrick Jon Harmon, Long Beach, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/453,362

(22) Filed: Jun. 3, 2003

(51) Int. Cl.[7] ..... H01Q 3/00; H01Q 3/02

(52) U.S. Cl. ..... 343/757; 343/853; 342/374; 342/375; 455/13.3

(58) Field of Search ..... 343/757, 853, 343/754, 786, 876; 342/157, 374, 375; 455/13.3

(56) References Cited

U.S. PATENT DOCUMENTS 5,355,512 A * 10/1994 Profera, Jr. ..... 455/13.3
6,317,100 B1 * 11/2001 Elson et al. ..... 343/853
6,421,021 B1 * 7/2002 Rupp et al. ..... 343/753

* cited by examiner

*Primary Examiner*—Tan Ho

(57) ABSTRACT

A satellite antenna system (30) that employs a small phased antenna array (46) acting as redundant antenna. Because the phased array (46) is steerable, it can be selectively directed to any of the cells (16) on the Earth (12) in the event that the LNA in an antenna channel (32) fails. The phased array (46) is switched into each antenna channel (32) after the channel front end (40) where a switch (56) used to switch in the phased array (46) is after the amplification in the channel (32). Therefore, the switch (56) does not significantly affect the noise figure of the channel front end (32).

9 Claims, 2 Drawing Sheets

STEERABLE UPLINK ANTENNA FOR MOVEABLE REDUNDANT BEAMS

BACKGROUND OF THE INVENTION

1. Field of the Invention

This invention relates generally to an antenna system providing redundant steerable beams and, more particularly, to an antenna system for a satellite that employs a small, phased antenna array that provides selectively steerable beams so that the redundant low noise amplifier in each antenna channel front end in the receiver of fixed antenna array can be eliminated and the antenna noise figure can be improved.

2. Discussion of the Related Art

Various communication systems, such as certain cellular telephone systems, cable television systems, intemet systems, military communication systems, etc., make use of satellites orbiting the Earth to transfer signals. A satellite uplink communications signal is transmitted to the satellite from one or more ground stations, and is then retransmitted by the satellite to another satellite or to the Earth as a downlink communications signal to cover a desirable reception area depending on the particular use. The uplink and downlink signals are typically transmitted at different frequencies. For example, the uplink communications signal may be transmitted at 30 GHz and the downlink communications signal may be transmitted at 20 GHz.

The satellite is equipped with an antenna system including a configuration of antenna feeds that receive the uplink signals and transmit the downlink signals to the Earth. Typically, the antenna system includes one or more arrays of feed horns and one or more antenna reflectors for collecting and directing the signals. Present antenna systems typically optimize the feed structure for the frequency band of interest and sacrifice other frequency bands. The uplink and downlink signals are typically circularly polarized so that the orientation of the reception antenna can be arbitrary relative to the incoming signal. To provide signal discrimination, one of the signals may be left hand circularly polarized (LHCP) and the other signal may be right hand circularly polarized (RHCP), where the signals rotate in opposite directions. Polarizers are employed in the antenna system to convert the circularly polarized signals to linearly polarized signals suitable for propagation through a waveguide with low signal losses, and vice versa.

FIG. 1 is an illustration of a spot beam satellite 10 orbiting the Earth 12. The satellite 10 includes an antenna system 14 that would include an array of antenna feeds, as would be well understood to those skilled in the art. Each feed is associated with a feed channel that may include separate transmitter and receiver architecture to transmit the downlink signal and receive the uplink signal. The satellite 10 may include multiple antenna arrays to increase or improve the coverage area on the Earth 12. Each feed in the antenna system 14 is configured to define a particular coverage cell 16 on the Earth 12. The feeds are directed to define contiguous cells 16, or provide a selected coverage area somewhere on the Earth 12. Each cell 16 would use signals in a particular sub-band within the uplink or downlink frequency band, or adjacent cells 16 would use different sub-bands at different points in time.

Each separate antenna feed channel includes a receiver front end providing signal amplification, typically by a low noise amplifier (LNA), and frequency down-conversion in a manner that is well understood to those skilled in the art. A failure of an LNA in the receiver front end would result in loss of an uplink signal. Because the LNA is a vital component for providing signal gain, and typically has an unacceptable failure rate, each antenna channel front end often employs a redundant LNA. Suitable switches are employed to switch the redundant LNA into the front end in the event that the main LNA fails. However, because the switch occurs in the front end prior to the signal amplification, the switch adversely adds to the noise figure of the receiver, and significantly affects the gain versus temperature noise (G/T) of the antenna system. Such an increase in the satellite G/T is an important design concern.

SUMMARY OF THE INVENTION

In accordance with the teachings of the present Invention, a satellite antenna system is disclosed that employs a small phased antenna array acting as a redundant steerable antenna. Because the phased array is steerable, it can be selectively directed to any of the cells on the Earth in the event that the LNA in an antenna channel fails. The phased array is switched into each antenna channel after the channel front end so that the switch used to switch in the phased array is after the amplification in the channel. Therefore, the phased array switch does not significantly affect the noise figure of the channel front end.

Further areas of applicability of the present invention will become apparent from the detailed description provided hereinafter. It should be understood that the detailed description and specific examples, while indicating embodiments of the invention, are intended for purposes of illustration only and are not intended to limited the scope of the invention.

DETAILED DESCRIPTION OF THE EMBODIMENTS

The following discussion of the embodiments of the invention directed to a satellite antenna system including a phased antenna array for beam redundancy purposes is merely exemplary in nature, and is in no way intended to limit the invention, or it's applications or uses.

Figure 1:
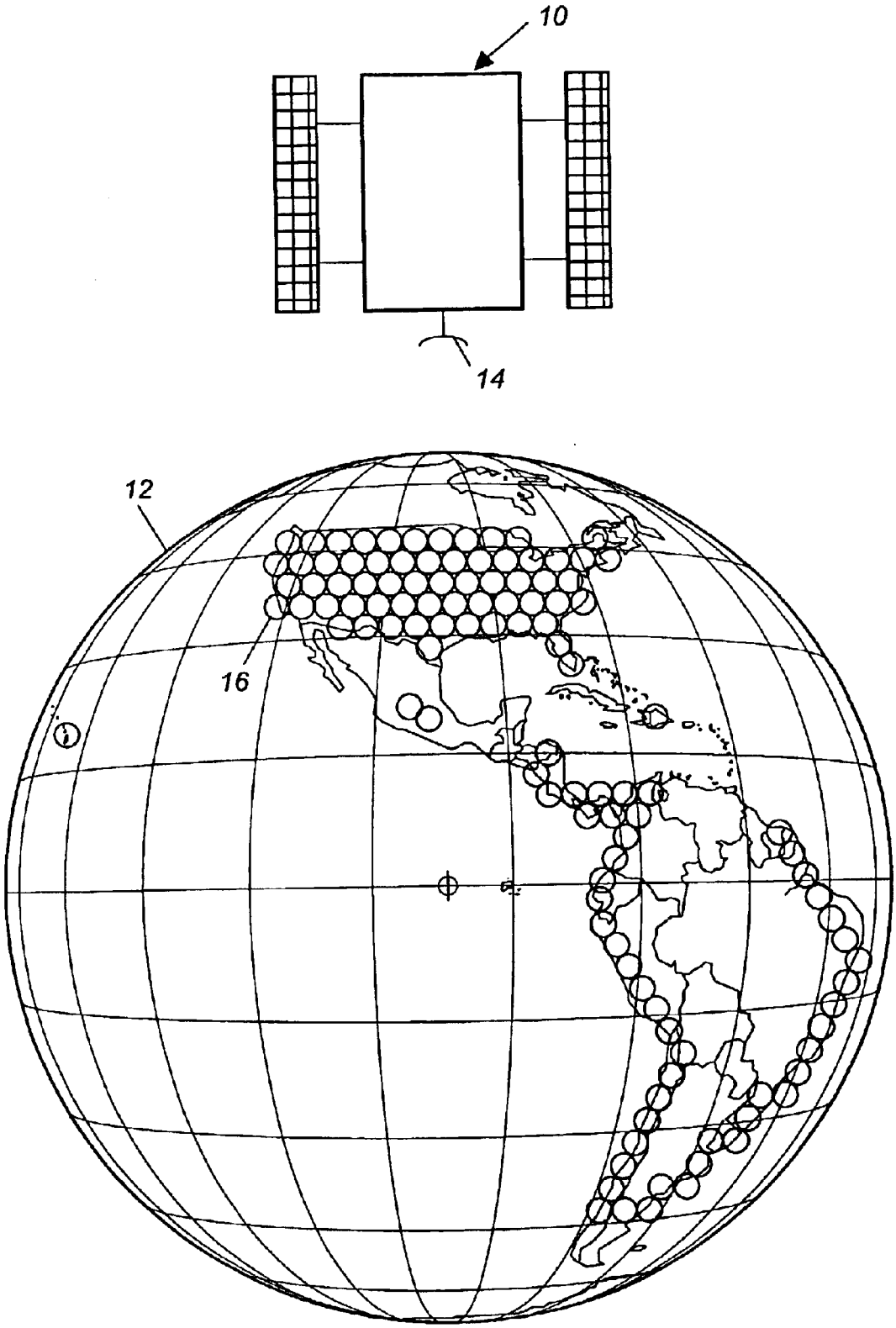
FIG. 1 is a plan view of a spot beam communications satellite relative to the Earth.
Figure 2:
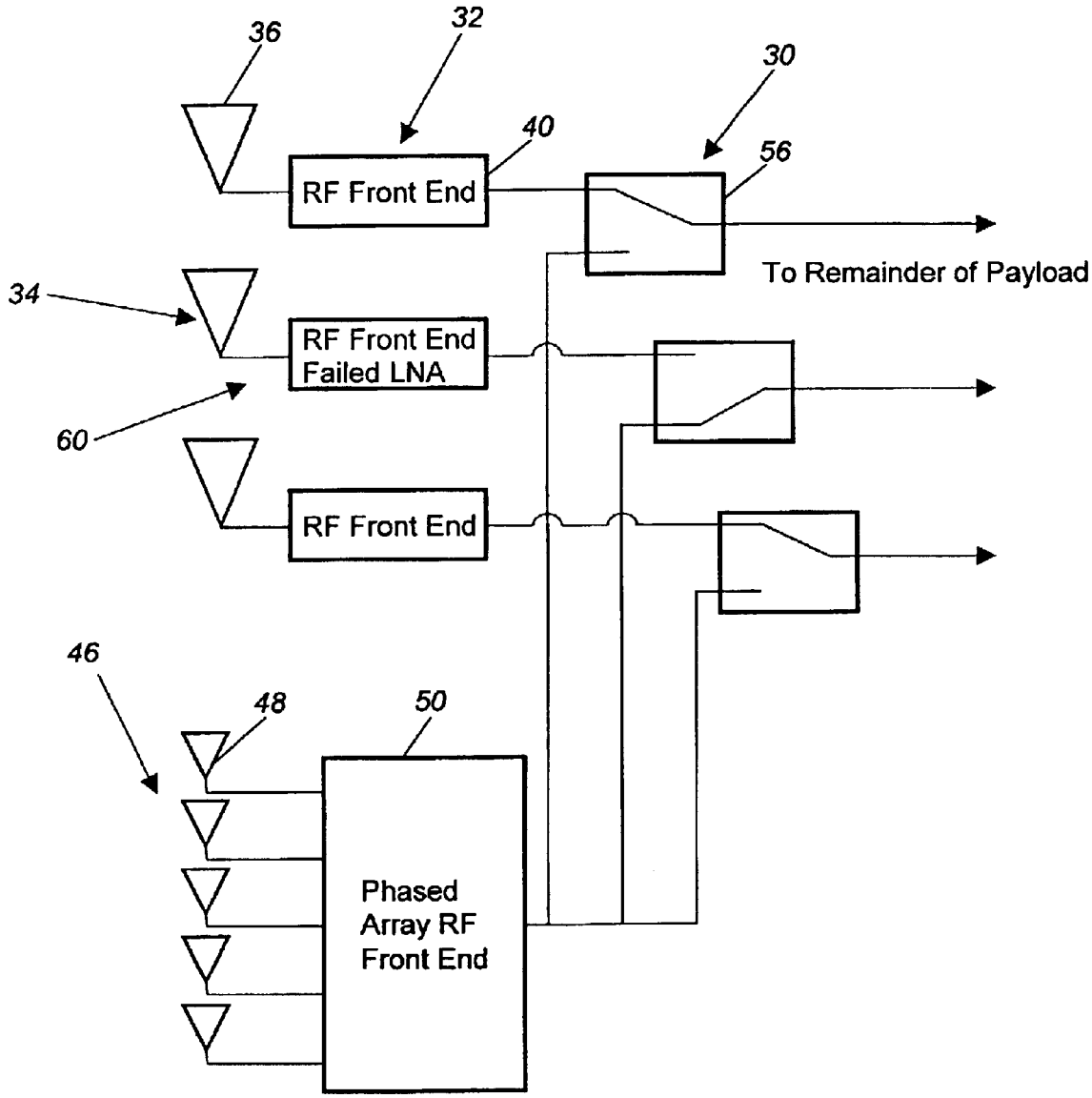
FIG. 2 is a schematic block diagram of an antenna system for the satellite shown in FIG. 1 employing a small, phased antenna array to provide redundancy for the fixed beam arrays, according to the invention.

FIG. 2 is a schematic block diagram of a satellite antenna system 30, according to an embodiment of the present invention. The system 30 includes a plurality of fixed beam antenna channels 32, three of which are shown here, that are part of a fixed beam antenna array 34. Each channel 32 includes an antenna feed 36 that is responsive to the uplink beams from a particular cell 16. The antenna feeds 36 can be any suitable feed for the purposes discussed herein, such as feed horns, antenna reflector systems, lenses, antenna slots, etc. The fixed beam array 34 can have any number of antenna feeds 36 that provides the desirable coverage for each cell 16 on the Earth 12. In one example, there are forty antenna channels 32 within the array 34. Each antenna channel 32 includes a receiver front end 40 that has the known receive front end components, such as an LNA, mixers and a frequency down-converter. In this design, the redundant LNA and switch in known antenna designs is eliminated in the front end 40.

According to the invention, the system 30 includes a phased antenna array 46 including a plurality of antenna feeds 48. The array 46 is a small array in that it only includes a few feeds 48 relative to the number of feeds 36 in the array 34. A small number of feeds 48 reduces the size, weight, complexity and cost of the system 30. In this example, the array 46 includes five feeds 48, but this is by way of a non-limiting example, in that any number of feeds 48 can be provided consistent with the discussion herein. Each antenna design that employs the phased antenna array 46 of the invention would be based on a cost/benefit analysis to determine the savings resulting from eliminating the redundant LNAs and switches, and those costs provided by adding the phased antenna array 46. This analysis would necessarily include the number of feeds 36 in the array 34, and the known failure rate of the main LNAs over time.

The array 46 includes a phased array receive front end 50 that includes the various front end components, including amplifiers, mixers and frequency down-converters, necessary for a phased array front end as would be known by those skilled in the art. The phased array front end 50 would also include a phase shifter for each separate feed 48 and a beam forming network (BFN) that combines the beams for each feed 48. As is well understood in the art, the phased array 46 is selectively steerable so that it can be directed to any of the cells 16 on the Earth 12. As is well understood in the art, a phased antenna array can generate one or more beams simultaneously, forming the beams by weighting the phase or amplitude of each feed 48 in the array 46. In this example, the array 46 can be selectively directed to five separate cells simultaneously, and thus provides redundant coverage for any five of the fixed beams.

Each channel 32 includes a switch 56 that receives the downconverted signal from the front end 40, as shown. Additionally, the switch 56 receives the down-converted signal from the phased array front end 50. In the normal mode, where all of the fixed beam channels 32 are operating properly, the switches 56 are switched to receive the fixed beam signals. The signal received by each channel 32, or the phased array 46, is then forwarded to the rest of the receiver components for signal processing and switching, as would be well understood to those skilled in the art.

In the event of an LNA failure, the phased array 46 is directed by phase weighting to the cell 16 of the failed channel 32 and the switch 56 for that channel 32 is switched to receive the phased array signal. Channel 60 is shown having a failed LNA, where the switch 56 for the channel 60 is switched to the array 46. As is apparent, the switch 56 is after the front end 40 so that it's noise figure does not affect the un-amplified signal, where it would have a significant affect on the G/T.

The description of the invention is merely exemplary in nature and, thus, variations depart from the gist of the invention are intended to be within the scope of the invention. Such variations are not to be regarded as a departure from the spirit and scope of the invention.

What is claimed is:

1. An antenna system comprising:

a fixed beam array, said fixed beam array including a plurality of antenna channels, each antenna channel including a fixed beam array antenna feed, a fixed beam array receiver front end and a signal switch, said signal switch being responsive to signals received by the fixed beam array antenna feed and amplified by the fixed beam array front end; and a phased array, said phased array including a plurality of phased array antenna feeds and a phased array receiver front end, each switch in the plurality of antenna channels being responsive to signals received by the phased array antenna feeds and amplified by the phased array front end.

2. The system according to claim 1 wherein each fixed beam array front end includes a single LNA.

3. The system according to claim 1 wherein the switch is positioned after the fixed beam array front end.

4. The system according to claim 1 wherein the antenna system is a satellite antenna system.

5. An antenna system for a satellite, said antenna system receiving satellite uplink signals, said system comprising:

a fixed beam array, said fixed beam array including a plurality of antenna channels, each antenna channel including a fixed beam array antenna feed, a fixed beam array receiver front end and a signal switch, said fixed beam array receiver front end including a single low noise amplifier (LNA), said signal switch being responsive to the uplink signals received by the fixed beam array antenna feed and amplified by the LNA; and a phased antenna array, said phased array including a plurality of phased array antenna feeds and a phased array receiver front end, each switch in each channel being responsive to signals received by the phased array antenna feeds and amplified by the phased array front end, wherein the phased array is selectively steerable to a particular cell on the Earth in the event that the LNA in a particular fixed beam antenna channel fails.

6. The system according to claim 5 wherein the switch is positioned after the fixed beam array front end in each channel.

7. A method of processing uplink signals in a satellite communications system, comprising:

receiving the uplink signals in a plurality of channels in a fixed beam array, each channel including an antenna feed, a receiver front end and a signal switch;

receiving the uplink signals in a phased antenna array, said phased array including a plurality of an antenna feeds and a receiver front end; and switching the received uplink signal from a fixed beam array channel to the phased array if an amplifier in the fixed beam array front end fails.

8. The method according to claim 7 wherein the signal switch is positioned in each channel after the fixed beam array front end.

9. The method according to claim 7 wherein each fixed beam array front end includes a single LNA.

* * * * *